US005806425A

United States Patent [19]

Newman et al.

[11] Patent Number: 5,806,425

[45] Date of Patent: Sep. 15, 1998

[54] RETRACTABLE ATTACHMENT FOR A SCREEN PRINTING MACHINE

[75] Inventors: Don E. Newman, Wyncote, Pa.; Thomas A. McKeever, Maple Shade, N.J.

[73] Assignee: Stretch Devices, Inc., Philadelphia, Pa.

[21] Appl. No.: 739,991

[22] Filed: Oct. 30, 1996

Related U.S. Application Data

[60] Provisional application No. 60/007,141 Nov. 1, 1995.

[51] Int. Cl. [6] ..... B41F 15/36

[52] U.S. Cl. ..... 101/127.1; 101/DIG. 36

[58] Field of Search ..... 101/126, 127.1, 101/128, 128.1, 128.4, 129, DIG. 36; 33/614, 617, 620, 621; 38/102, 102.1, 102.4, 102.6, 102.91

[56] References Cited

U.S. PATENT DOCUMENTS

| | | | |
|---|---|---|---|
| Re. 32,731 | 8/1988 | Jennings et al. | 101/35 |
| 1,072,908 | 9/1913 | Buda . | |
| 2,680,405 | 6/1954 | Faeber et al. | 101/401.2 |
| 2,701,420 | 2/1955 | Monroy et al. | 33/184.5 |
| 3,098,431 | 7/1963 | Weaver | 101/126 |
| 3,492,900 | 2/1970 | Hill et al. | 83/464 |
| 3,943,851 | 3/1976 | Inada et al. | 101/127.1 |
| 4,223,055 | 9/1980 | Castelluzzo et al. | 428/40 |
| 4,226,181 | 10/1980 | Ericsson | 101/129 |
| 4,438,693 | 3/1984 | Serrianne et al. | 101/129 |
| 4,516,495 | 5/1985 | Ericsson | 101/129 |
| 4,612,856 | 9/1986 | Jennings | 101/129 |
| 4,738,909 | 4/1988 | Jennings | 430/22 |
| 4,901,638 | 2/1990 | Jennings | 101/126 |
| 4,911,070 | 3/1990 | Miske et al. | 101/126 |
| 4,938,130 | 7/1990 | Thorpe | 101/126 |
| 4,972,773 | 11/1990 | Barlow | 101/127.1 |
| 4,993,166 | 2/1991 | Bradley | 36/619 |
| 5,094,160 | 3/1992 | Jennings | 101/127.1 |
| 5,094,161 | 3/1992 | Taylor | 101/129 |
| 5,099,757 | 3/1992 | Jennings | 101/115 |
| 5,127,176 | 7/1992 | Newman | 38/102.1 |
| 5,163,367 | 11/1992 | Newman | 101/127 |
| 5,188,026 | 2/1993 | Fuqua et al. | 101/129 |
| 5,226,366 | 7/1993 | Schlife et al. | 101/485 |
| 5,315,929 | 5/1994 | Sundqvist | 101/127.1 |
| 5,377,422 | 1/1995 | Newman | 33/620 |
| 5,398,602 | 3/1995 | Taylor | 101/129 |
| 5,483,882 | 1/1996 | Jaffa | 101/128 |
| 5,503,068 | 4/1996 | Newman | 101/126 |
| 5,522,148 | 6/1996 | Newman | 33/620 |

FOREIGN PATENT DOCUMENTS

| | | |
|---|---|---|
| 1 564 498 | 4/1990 | United Kingdom . |
| 2 067 468 | 7/1991 | United Kingdom . |

OTHER PUBLICATIONS

Richardson Brochure, date unknown.

Vennell, "Preregistration," Jul. 1983.

Diamond–Chase Co. Brochure entitled "Diamond Pin System 1993".

Brochure from M&R Printing Equipment Inc. entitled "World Class Manufacturer Of Screen Printing Equipment For Graphic And Textile Applications," date unknown.

Brochure from M&R Printing Equipment Inc. entitled "If Accuracy, Speed And Smooth Operation Matter To You, This is Big News!," date unknown.

*Primary Examiner*—Ren Yan

*Attorney, Agent, or Firm*—Seidel, Gonda, Lavorgna & Monaco, PC

[57] ABSTRACT

A retractable registration apparatus is mounted on a screen printing type press for aligning a printing frame with an image platform, such as a vacuum table. The apparatus has a pair of registration pins for coupling with the printing frame and a registration appendage which carries the registration pins. The registration appendage is rotatably mounted to the printing press for rotation from a registration position to a retracted position. A locking mechanism retains the appendage with the registration pins in the exact registration position.

21 Claims, 7 Drawing Sheets

RETRACTABLE ATTACHMENT FOR A SCREEN PRINTING MACHINE

This application claims the benefit of U.S. Provisional application Ser. No. 60/007,141, filed on Nov. 1, 1995.

FIELD OF THE INVENTION

The present invention relates to a retractable registration system for aligning a screen printing frame and screen mesh in a printing machine. More particularly the present invention relates to a registration system that retracts for allowing micro-registration of the screen printing frame.

BACKGROUND OF THE INVENTION

In a majority of screen printing operations, more than one color is used to create the printed image. The use of more than one color requires using several screens, one for each color. Each screen has a stencil related to the associated image for that color. It is therefore necessary to ensure that the images from each of the screens align properly so that the associated colors align properly. This is typically done by ensuring that the image on the screen mesh is properly aligned on the printing frame and by aligning the printing frames, such as a roller frame, to a platform, such as a vacuum table, which receives a substrate or article, such as a poster, that is to receive the image.

One conventional method for aligning the screen printing frame on a vacuum table in a printing machine is to fix a first printing frame and then to do several test prints. In a typical printing machine, a single color image is produced for the entire run prior to removing the printing frame containing that color image from the machine. A second screen printing frame containing a second image, presumably for a second color, is then installed. The vacuum table is moved under the printing frame. The printing frame is first grossly adjusted by looking through the image on the mesh on the printing frame and comparing it to the image on the substrate below. The printing frame is adjusted by moving the second image relative to the first image. Thereafter, a test print is performed and the printing frame is micro-adjusted to correct for errors. This process is repeated until the second color is aligned properly in the printing machine. Additional colors are adjusted in similar fashion.

One of the difficulties in this method of registration of the colors of an image to be printed is that upon removing the printing frame from the printing machine, the plurality of clamps used to retain the printing machine are moved, making it difficult to grossly adjust the next printing frame in the same location. Therefore, even if each image is properly aligned within the printing frame, the frames themselves must be properly aligned within the printing machine.

U.S. Pat. No. 5,648,189 entitled "Pin Registration for Screen Printing", filed Oct. 27, 1995, describes a process for aligning the image on the printing frame. This commonly assigned Patent is hereby incorporated herein by reference.

It is desired to have a registration system that would allow for quick registration of a printing frame and the mesh retained thereon and, in addition, allow the registration to retract without removal from the machine.

SUMMARY OF THE INVENTION

The present invention relates to a retractable registration apparatus for a screen printing machine. The apparatus is used for aligning multiple printing frames with an image platform. The apparatus has a pair of registration mechanism, such as pins, for coupling with the printing frame and a registration appendage which carries the registration mechanism. The registration appendage is rotatably mounted to the printing machine for allowing rotation of the appendage from a registration position to a retracted position. A locking mechanism, retains the appendage in the exact registration position.

Further objects, features and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
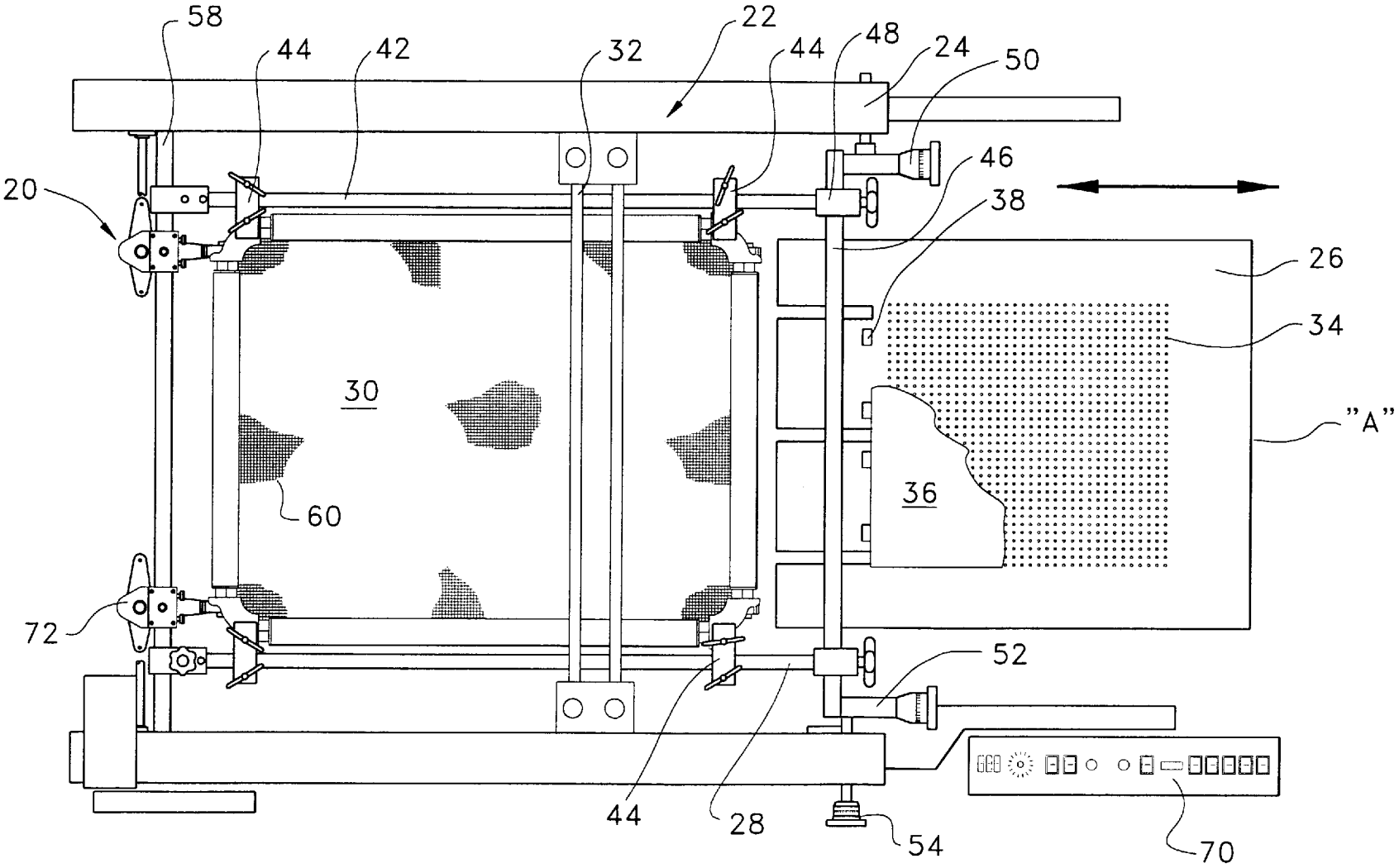
FIG. 1 is a top view of a graphic screen printing machine having a registration system of the present invention.

Referring to the drawings in detail, where like numerals indicate like elements, there is illustrated a retractable registration apparatus in accordance with the present invention which is generally designated with the numeral 20.

Figures 2, 3:
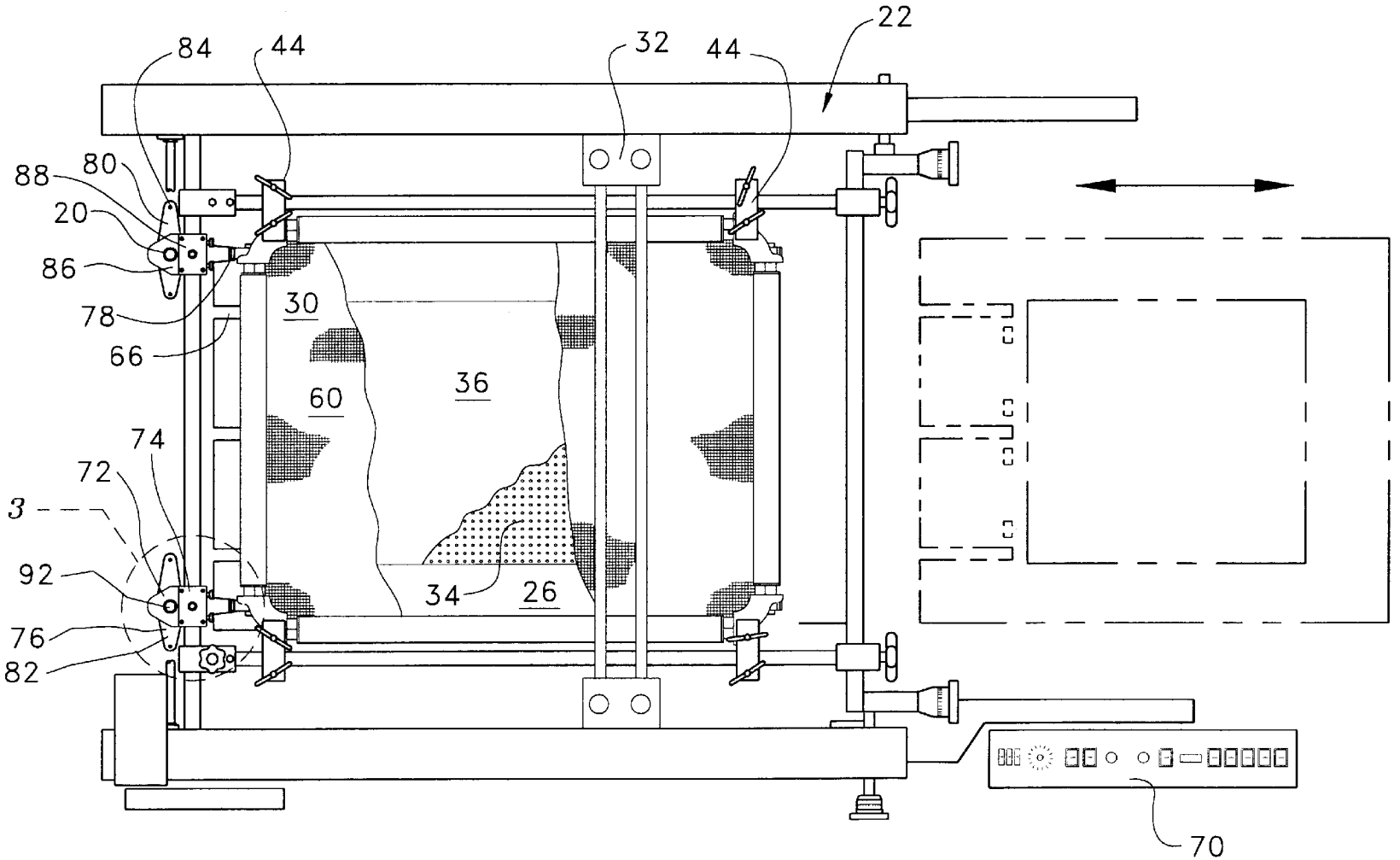
FIG. 2 is a top view of the graphic screen printing machine having the registration system of the present invention. The screen printing frame and the substrate are broken away to show the vacuum table in a printing position. The vacuum table is shown in phantom in a substrate installation position.
FIG. 3 is an enlarged top view of the section labeled FIG. 3 encircled in FIG. 2 showing the registration system in a registration position.
Figure 3:
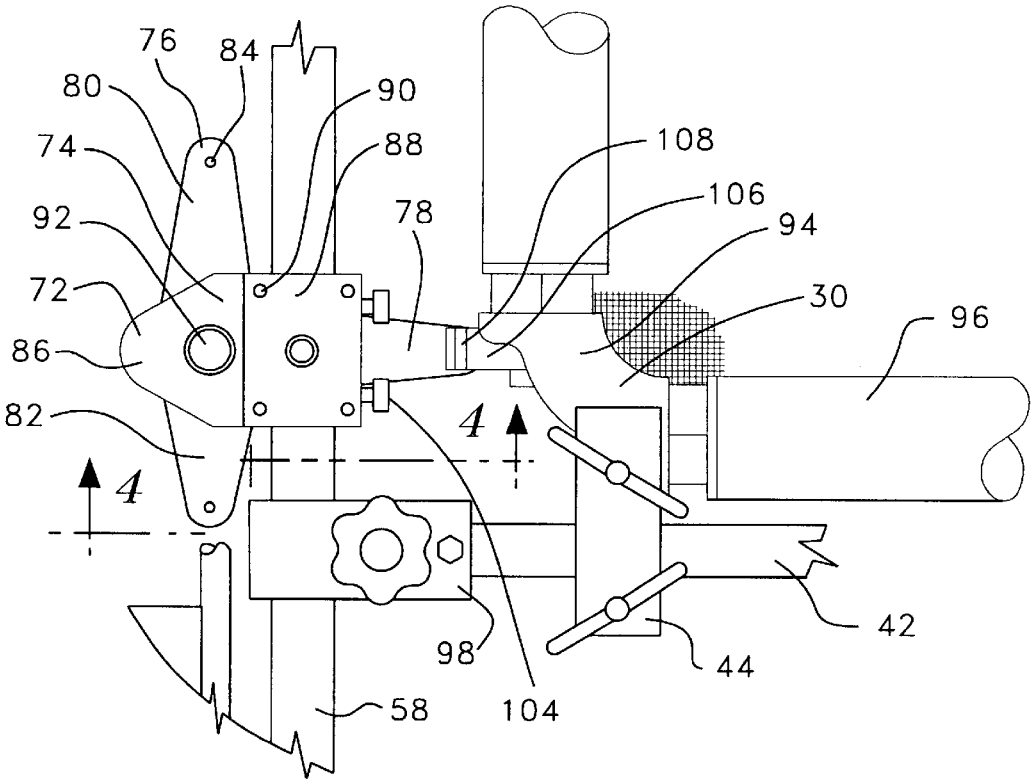

Referring to FIG. 1, the retractable registration apparatus 20 is shown within a screen printing machine 22. The printing machine 22 has a frame 24, a vacuum table or bed 26, a frame holder 28 for receiving a screen printing frame 30, and a head 32 for receiving a squeegee and flood bar (not shown). The vacuum table 26 has a plurality of holes 34 for drawing a suction therethrough and for securing thereto a substrate 36 to be printed on, such as a high quality fiber board. The table 26 has a plurality of fingers 38 for locating the substrate 36 longitudinally. The table 26 may also include an additional set of stops (not shown) to locate the substrate laterally. The vacuum table 26 moves along the graphics printing machine's longitudinal axis "A" on a track (not shown) such that the table 26 rolls under the printing frame 30 which is retained by the frame holder 28 (FIG. 2).

The frame holder 28 includes a pair of parallel mounting bars 42. Each bar 42 has a pair of mounting clamps 44 for securing the printing frame 30. The mounting bars 42 are secured to a forward transverse bar 46 of the frame holder 28 by a plurality of clamps 48. The mounting bars 42 and the forward transverse bar 46 of the frame holder 28 move in unison.

The printing machine 22 has a plurality of adjustment mechanisms 50, 52 and 54 for positioning the frame holder 28 and printing frame 30 relative to the frame 24 of the printing machine 22. The first and second adjustment mechanism 50, 52 move the frame holder 28 and printing frame 30 in the longitudinal direction. The third adjustment mechanism 54 moves the first two adjustment mechanisms 50, 52, the frame holder 28, and the printing frame 30 in a lateral direction. The movement of one of the adjustment mechanisms 50 or 52, without the same movement of the other will result in a yaw movement (rotation about a line perpendicular to the plane of screen mesh 60) of the printing frame 30, which may or may not be desired.

The frame holder 28 has a rear transverse bar 58. The rear bar 58, in the printing machine 22 shown and described, is rigidly attached to the frame 24 of the machine 22. The rear transverse bar 58 does not move with the adjustment mechanisms 50, 52, 54. The pair of parallel mounting bars 42 are slidable connected to the rear transverse bar 58, such that the bars 42 can move both laterally and longitudinally with the adjustment mechanisms 50, 52, 54 relative to the rear transverse bar 58.

The head 32 of the printing machine 22 is located above the screen printing frame 30. The head 32 moves in longitudinal direction and contains the flood bar (not shown) for flooding the screen or mesh 60 on the printing frame 30 with ink. The squeegee (also not shown) is also retained on the head 32. The squeegee deflects the mesh toward the substrate, placing ink on the substrate in accordance with the image on the mesh. The head 32, for example, moves to the right with the flood bar lowered to flood the screen, and to the left with the squeegee lowered to print. This printing operation is performed with the vacuum table 26 in a printing position as shown in FIG. 2.

In FIG. 2, a portion of the screen printing frame 30 and screen mesh 60 is shown broken away so as to illustrate the substrate 36 and the vacuum table 26. A portion of the substrate 36 is also broken away so as to show the holes 34 in the vacuum table 26. The vacuum table 26 is shown in a printing position. Upon the image 62 being transferred from the mesh 60 on the printing frame 30 to the substrate 36, a series of feet 66 on the vacuum table 26 are used for removing the substrate 36 as the vacuum table 26 moves back to the install position. The substrate 36 is then dropped to a shuttle conveyor (not shown) which is located below the printing frame 30. The shuttle conveyor moves the substrate to the left (as seen in FIG. 2) away from the printing machine 22. The operation of the graphics printing machine 22 is controlled by a control panel 70 and a foot pedal (not shown).

The printing machine 22 described above is well known. It is recognized that variations to the machine exist and may be utilized with the present invention.

In FIG. 2, the retractable registration apparatus 20 has a pair of registration mechanisms 72 which are shown in a registration position. This registration position for the mechanism 72 is more particularly shown in FIG. 3. Since each of the registration mechanisms 72 are similar, only one will be described below.

The registration mechanism 72 has a mounting portion 74 and an appendage 76. The appendage 76 has a plurality of fingers 78, 80, 82, each having a registration pin 84. The plunger bolt 92 serves as a coupling which connects the appendage 76 to the mounting portion 74. The mounting portion 74 includes a mounting bracket 86 and a plate 88. The plate 88 is secured to the mounting bracket 86 by a plurality of fasteners 90. The appendage 76 is pivotably mounted to the mounting bracket 86 by a rotatable plunger bolt 92.

The mounting clamps 44 extend between a corner members 94 of the printing frame 30 and the mounting bar 42. (The corner members 94 are interposed between the rollers 96 which form the sides of the frame 30.) The mounting bar 42 is slideably carried by the rear transverse bar 58. The mounting bar 42 can be locked in position relative to the rear transverse bar 58 by locking mechanism 98. The locking mechanism 98 includes a pair of plates for engaging the top and bottom of the rear transverse bar 58.

Figure 4:
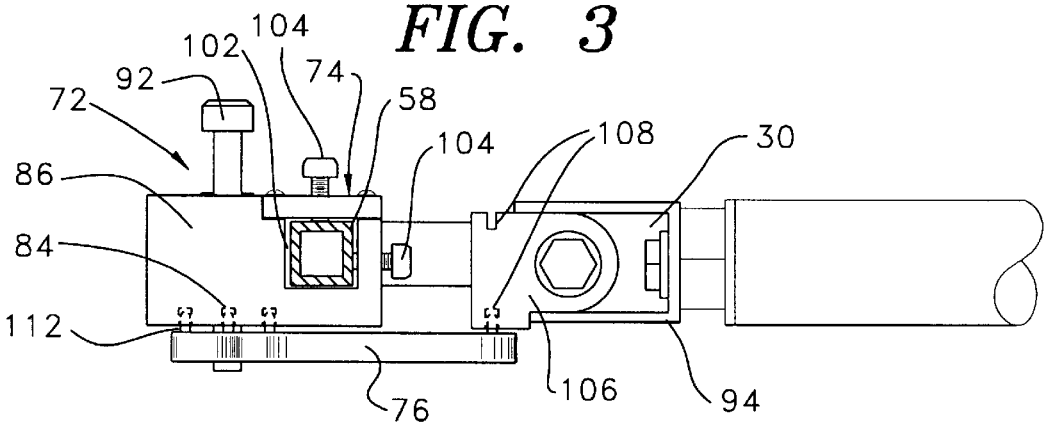
FIG. 4 is a side view of the registration apparatus in a registration position taken along line 4—4 of FIG. 3.

Referring to FIG. 4, the mounting bracket 88 has a U-shaped channel 102 through which the rear transverse bar 58 extends. The mounting portion 74 of the registration mechanism 72 has a plurality of set screws 104 for securing the registration mechanism 72 on the rear transverse bar 58. The printing frame 30 has an adapter 106 adjacent the corner member 94. The adaptor includes a registration element or opening 108, such as a hole or slot, which receives the registration pin 84. U.S. Pat. Nos. 5,377,422 and 5,522,148 disclose roller frames having an adapter or corner member having a hole and a slot for engagement of the registration pins of the type shown. These patents are herein incorporated by reference.

Figure 5:
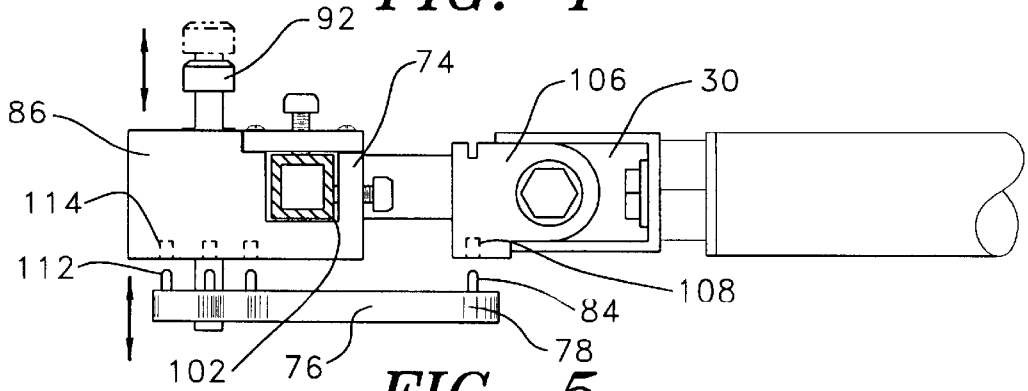
FIG. 5 is a view similar to FIG. 4 with the registration apparatus in a decoupled position.

Referring to FIG. 5, the rotatable plunger bolt 92 is depressed to place the appendage 76 in a decoupled position relative to the mounting bracket 86 of the mounting portion 74. The appendage 76 has a plurality of alignment pins 112, in addition to the registration pins 84. The alignment pins 112 are received by a plurality of openings 114, shown in hidden line, in the mounting bracket 74. The alignment pins 112 and openings 114 are a detent or locking means for fixing the appendage 76 in the registration position and a retaining means for setting the appendage 76 in the retracted position (shown in FIG. 7). With the appendage 76 in the decoupled position (FIG. 5), the registration pin 84 is located below the printing frame 30 and the adapter 106. Also, the appendage 76 can be rotated about the plunger bolt 92 relative to the mounting bracket 86.

Figure 6:
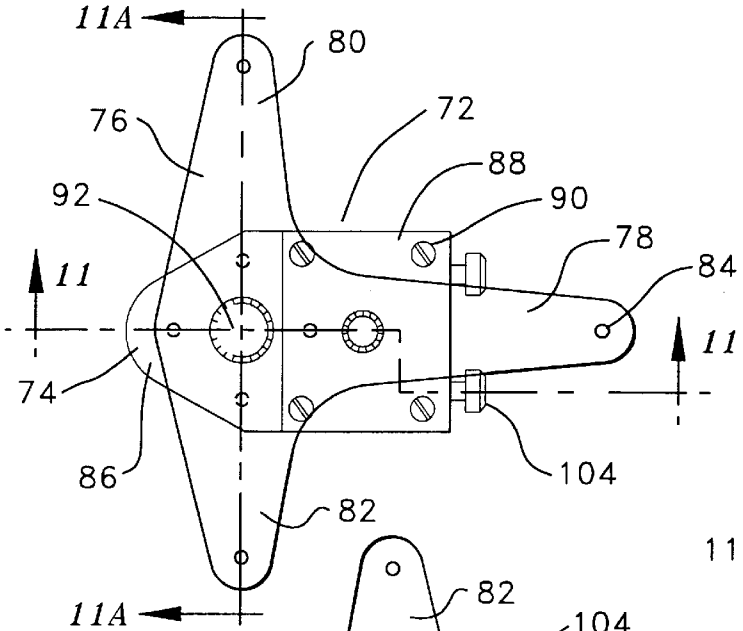
FIG. 6 is a top view of the registration apparatus removed from the graphics printing machine in one of the registration positions.
Figure 6A:
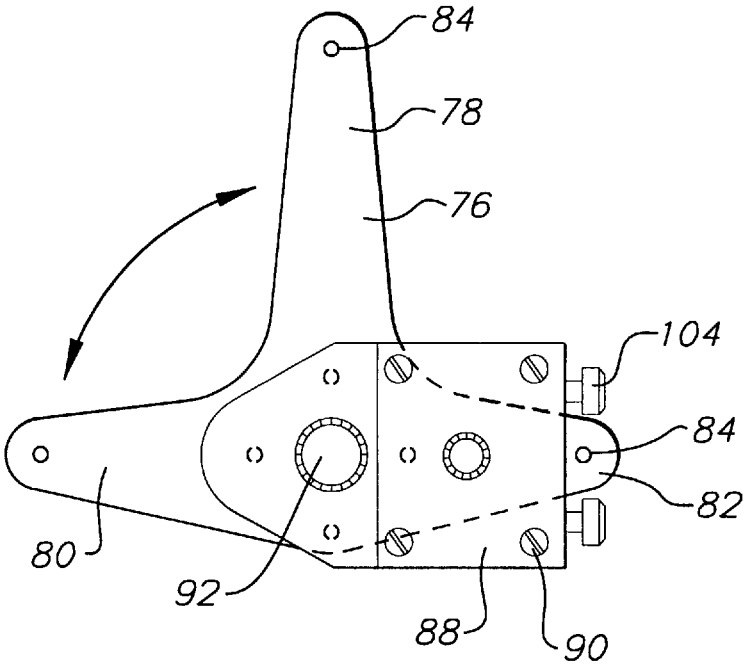
FIG. 6A is a top view of the registration apparatus removed from the graphics printing machine in another of the registration positions.

Referring to FIG. 6, the top view of the registration mechanism 72 is show without the rear transverse bar 58. The plate 88 is secured to the mounting portion 74 by the plurality of fasteners 90. The set screws 104 extend outwardly from the registration mechanism 72. The rotatable plunger bolt 92 extends through the mounting bracket 86. The appendage 76 is shown with the longest finger 78 extending along mounting bracket 86 and projecting outwardly therefrom. The registration pin 84 on the end of the finger 78 extends upwardly. In FIG. 6A, the appendage 76 has been rotated such that the shortest finger 82 extends along the mounting bracket 86 and projects outwardly therefrom.

Figure 7:
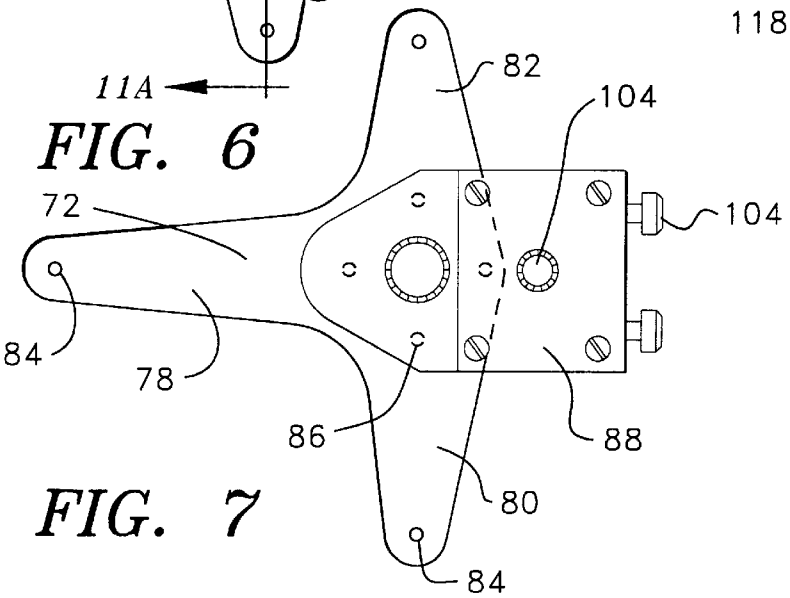
FIG. 7 is a top view of the registration apparatus removed from the graphics printing machine in a retracted position.

Referring to FIG. 7, the appendage 76 is shown with none of the fingers 78, 80 and 82 projecting along the mounting bracket 86. The registration mechanism 72 is in a retracted position. This is the position of the registration mechanism 72 where micro adjusting and printing may occur. This micro adjustment and printing operation is described in further detail below.

Figure 8:
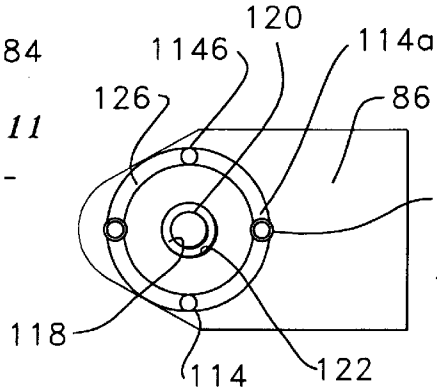
FIG. 8 is a bottom view of a mounting portion of the registration apparatus.

Referring to FIG. 8, the mounting bracket 86 has a bore 118 for receipt of the rotatable plunger bolt 92. A bushing 120 is provided in the lower portion 124 of the bore 118 and is interposed between the plunger bolt 92 and the inside wall 122 of the bore 118. A track 126 is cut into the bottom surface of the mounting bracket 86 and is adapted to receive the alignment pins 112 of the appendage 76. The mounting bracket 86 has the plurality of openings 114 for receiving the alignment pins 112. Two of the openings 114*a* have a bushing 128 for precise positioning of the appendage 76. The other two openings 114*b* are clearance holes.

Figure 9:
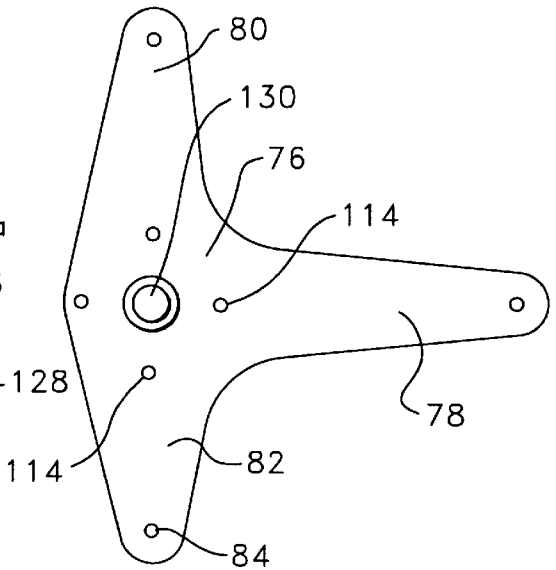
FIG. 9 is a top view of the appendage of the registration apparatus.
Figure 10:
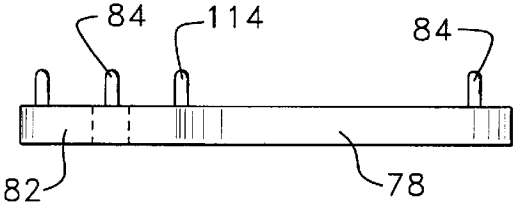
FIG. 10 is a side view of the appendage of the registration apparatus.

FIGS. 9 and 10 show the appendage 76, each of the three fingers 78, 80, 82 and the respective registration pins 84. The four alignment pins 114 encircle a counter bored hole 130. The hole 130 receives the rotatable plunger bolt 92.

Figure 11:
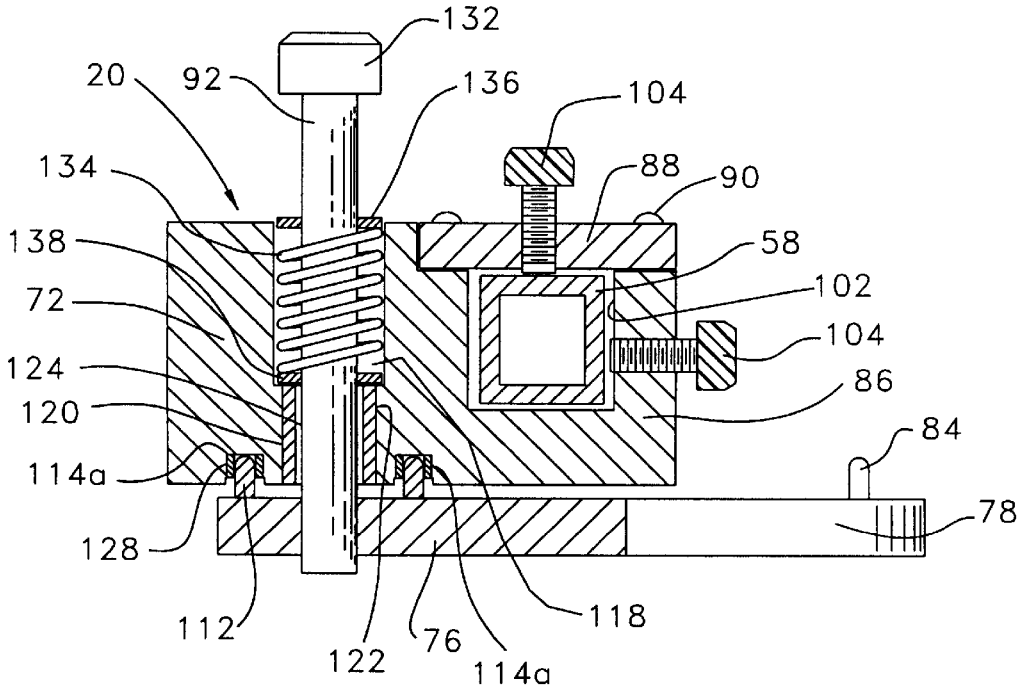
FIG. 11 is a sectional view taken along the line 11—11 of FIG. 6, with the rear transverse bar shown.
Figure 12:
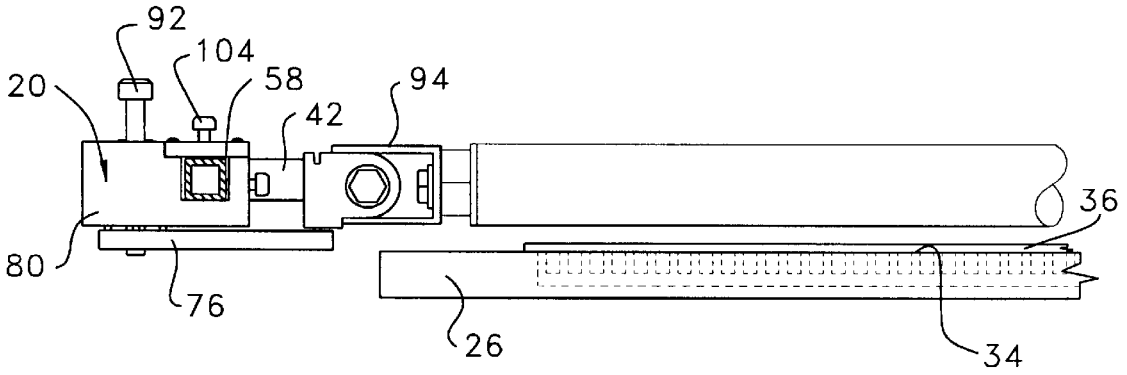
FIG. 12 is a side view of the registration apparatus in a retracted position and the vacuum table with substrate underlying the screen printing frame.
Figure 11A:
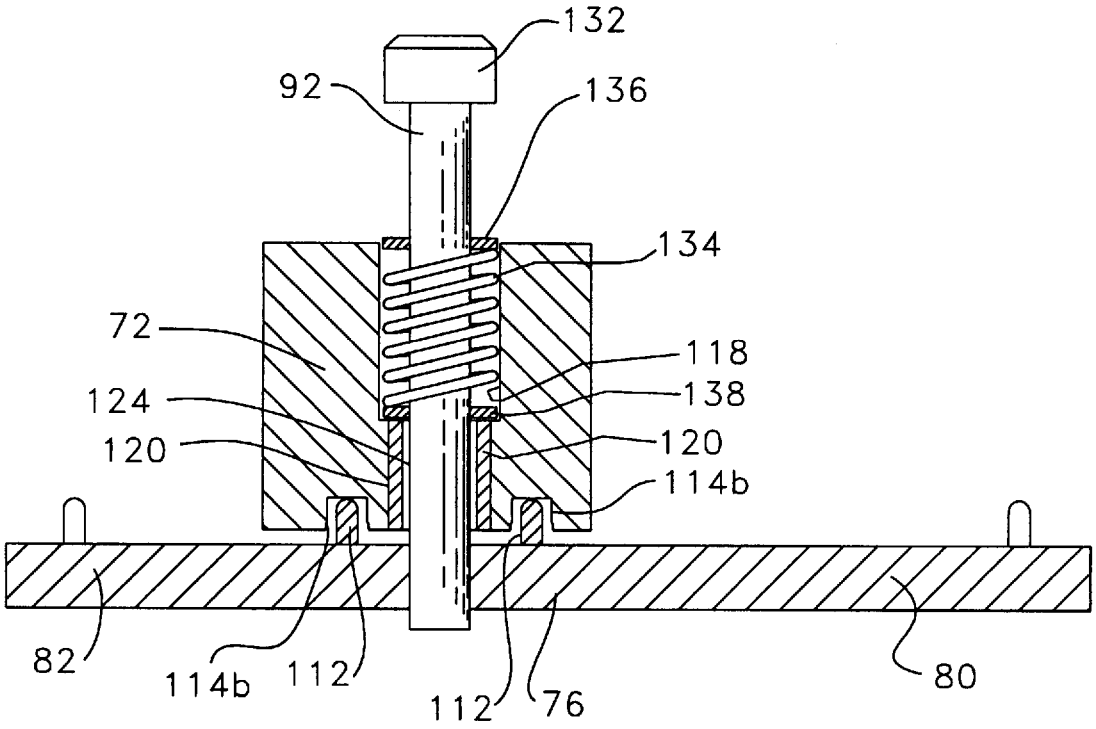
FIG. 11A is a sectional view taken along the line 11A—11A of FIG. 6, with the rear transverse bar shown.

FIG. 11 is a cross sectional view of the registration mechanism 72 with the rear transverse bar 58 extending through the U-shaped channel 102. The registration mechanism 72 is held in place by the set screws 104. The rotatable plunger bolt 92 has a head 132 at one end, extends through the bore 118 in the mounting bracket 86 and is attached to the appendage 76 at the opposite end. In the lower portion 124 of the bore 118, the bushing 120 is provided between the inside surface of the bore and the plunger bolt 92. A spring 134 is located in the bore 118 between a pair of washers 136 and 138. The upper washer 136 is preferably secured to the plunger bolt 92. When the plunger bolt 92 is depressed to the decoupled position (as shown in FIG. 5), the spring 134 is compressed and provides a upward force on the plunger bolt 92 and the appendage 76. The alignment pins 112 are shown positioned within the bushings 128 within the holes 114*a*. In the cross section in FIG. 11A, two of the alignment pins 112 are shown within the clearance holes 114*b*.

Referring to FIGS. 3 and 5, when a printing frame 30 is to be aligned and secured to the frame holder 28 to set up a printing operation, the printer depresses the head 132 of the rotatable plunger bolt 92 to decouple the appendage 76 from the mounting portion 74 of the registration mechanism 72. The plunger bolt 92 and appendage 76 are then rotated until the desired finger 78, 80, 82 projects toward the vacuum table 26. The plunger bolt 92 is then released and the spring 134 urges the appendage 76 upward to the engaged position as shown in FIG. 4. The registration pin 84 on the extended finger (78, 80 or 82) of the retractable registration apparatus 20 is then inserted into the opening 108 in the adaptor 106 on the printing frame 30. The mounting clamps 44 then secure the printing frame 30 in the desired position on the parallel mounting bars 42.

If the pair of registration mechanisms 72 are not properly spaced on the rear transverse bar 58. The set screws 104 on one of the registration mechanism 72 are loosened and the registration mechanism 72 is moved laterally along the bar 58. This operation should only have to occur when the size of the screen printing frame 30 is being changed.

After the mounting clamps 44 are set, the head 132 of the plunger bolt 92 is depressed to decouple the appendage 76 from the mounting portion 74 of the registration mechanism 72. The plunger bolt 92 is then rotated until the appendage 76 is in the retracted position as shown in FIG. 7.

With the screen printing frame 30 positioned in the frame holder 28 of the printing machine 22, the vacuum table 26 (having a substrate 36 thereon) is moved to the printing position, underlying the printing frame 30. Depending on the position of the appendage 76 and the location of the vacuum table 26 in the printing position, the extended finger (78, 80, 82) could interfere with the movement of the vacuum table 26. This is one of the reasons for moving the registration apparatus 20 to the retracted position. A test print is then accomplished. The series of feet 66 which mesh with the vacuum table 26 remove the substrate 36 from the vacuum table 26 as the vacuum table 26 moves back to the substrate install position. The substrate 36 is dropped to the shuttle conveyor (not shown) and moves to the left (as seen in FIG. 2) out of the printing machine 22.

The image 62 on the screen mesh 60 should be properly aligned so that the entire run of that image can be completed. However, if the image is not properly aligned, the printer determines what direction the image on the printing frame 30 has to moved relative to the vacuum table 26 and the substrate 36. The printer then loosens the locking mechanisms 98 and adjusts the appropriated adjustment mechanisms 50, 52, 54 to move the printing frame 30 either laterally or longitudinally (or both). The movement of one of the adjustment mechanisms 50 or 52 without the same movement of the other will result in a yaw movement (rotation about a line perpendicular to the plane of screen mesh) of the printing frame 30, which may or may not be desired. The locking mechanisms 98 are then re-tightened.

The adjustment of the screen printing frame 30 by the adjustment mechanism 50, 52, 54 is not possible if the registration pin 84 is still located in the opening 108 in the adapter 106 of the screen printing frame 30 in the style of printing machine shown in the drawings. Also, in the machine described above, the rear transverse bar 58, upon which the retractable registration apparatus 20 is mounted, does not move with the mounting bars 42. It is recognized that on certain machines that the rear transverse bar 58 moves with the mounting bars 42 and a different style locking mechanism 98 is used.

It is also recognized that the appendage could have a single finger, two fingers or in excess of three fingers. In addition, the mounting bracket could be mounted to the transverse bar such that the rotatable plunger bolt is located between the rear transverse bar and the screen printing frame.

The present invention may be embodied in other specific forms without departing from the spirit or essential attributes thereof and, accordingly, reference should be made to the appended claims, rather than to the foregoing specification, as indicating the scope of the invention.

What is claimed is:

1. In a screen printing machine of the type having a printing frame carried by a pair of parallel bars, a plurality of adjustment mechanisms for adjusting the screen printing frame both laterally and longitudinally along the bars, and a vacuum table adapted for carrying a substrate to be printed on, the vacuum table movable longitudinally between a substrate receiving position and a print position, comprising:

a pair of registration mechanisms for coupling with the screen printing frame; each registration mechanism having a rotatable appendage and a mounting portion having a mounting block;

registration means carried by each of the appendages adapted to engage a screen printing frame;

a rotatable plunger bolt interposed between the mounting block and the appendage of each registration mechanism for rotating the appendage from a registration position to a retracted position; and locking means for retaining the appendages and the registration means in a desired position.

2. In a printing machine as claimed in claim 1, wherein the mounting block of the registration mechanism includes a bore through which the rotatable plunger bolt extends, the registration mechanism also including a spring encircling the plunger bolt and received by the bore within the mounting block for biasing the appendage to an engaged position within the mounting block.

3. A retractable registration apparatus adapted to be mounted on a printing machine for aligning a screen printing frame with a holder, the apparatus comprising:

a mount for securing the registration apparatus to a printing machine;

an appendage pivotably attached to the mount by a coupling;

a registration pin attached to the appendage;

the appendage being pivotable with respect to a screen printing frame holder into and out of a registration position, in the registration position the appendage is aligned with the screen printing frame holder and the pin is positioned to be engaged by a registration element on a screen printing frame which is securable by the holder and when out of the registration position the pin on the appendage is retracted away from the screen printing frame; and a detent for releasably fixing the appendage in the registration position.

4. The retractable registration apparatus according to claim 3, wherein the detent further retains the registration appendage in the retracted position.

5. The retractable registration apparatus according to claim 3, wherein the appendage comprises a plurality of registration pins attached thereto.

6. The retractable registration apparatus according to claim 5, wherein the appendage comprises a plurality of radially extending fingers, each registration pin being located at an end of one of the fingers.

7. The retractable registration apparatus according to claim 3, wherein the appendage comprises a radially extending finger, the registration pin being located at an end of the finger.

8. The retractable registration apparatus according to claim 3, wherein the detent comprises one of a pin and plurality of spaced holes located on the appendage and the other of the pin and spaced holes located on the mount.

9. The retractable registration apparatus according to claim 3, wherein the coupling comprises a rotatable plunger bolt interposed between the mount and the appendage for rotating the appendage into and away from a registration position.

10. The retractable registration apparatus according to claim 9, wherein a bore is formed in the mount, the plunger bolt extends through the bore, and wherein the coupling further comprising a spring which encircles the plunger bolt, the spring being received by the bore within the mount for biasing the appendage to an engaged position within the mount.

11. The retractable registration apparatus according to claim 3, wherein the mount is adjustably mounted on the printing machine for accommodating variously-sized screen printing frames.

12. A retractable registration apparatus adapted to be mounted on a printing machine for aligning a printing screen frame with a holder, the apparatus comprising:

a pair of retractable registration mechanisms, each mechanism comprising a mount for securing the registration apparatus to a printing machine;

an appendage pivotably attached to the mount by a coupling, the appendage having a plurality of radially extending fingers;

one of a pin and an opening located at the end of each finger for coupling with the other of the pin and the opening formed on a printing screen frame;

a rotatable plunger bolt interposed between the mount and the appendage for pivoting the appendage with respect to a screen printing frame holder into and out of a registration position, in the registration position the appendage is aligned with the screen printing frame holder and the one pin or opening is positioned to be engaged by the other pin or opening on the screen printing frame, and when out of the registration position the one pin or opening on the appendage is retracted away from the screen printing frame; and a detent for releasably fixing the appendage in the registration position.

13. The retractable registration apparatus according to claim 12, wherein the detent further retains the registration appendage in the retracted position.

14. The retractable registration apparatus according to claim 12, wherein a bore is formed in the mount, the plunger bolt extends through the bore, and further comprising a spring which encircles the plunger bolt, the spring being received by the bore within the mount for biasing the appendage to an engaged position within the mount.

15. The retractable registration apparatus according to claim 12, wherein the mount is adjustably mounted on the printing machine for accommodating variously-sized screen printing frames.

16. A retractable registration apparatus adapted to be mounted on a printing machine for aligning a screen printing frame with a holder, the apparatus comprising:

a mount; an appendage pivotably attached to the mount by a rotatable plunger bolt interposed between the mount and the appendage; a registration means on the appendage for coupling with a registration element on a screen printing frame; the appendage being pivotable into and out of a registration position in which the registration means is positioned to be engaged by the registration element; and a detent for releasably fixing the appendage in the registration position.

17. A retractable registration apparatus adapted to be mounted on a printing machine for aligning a screen printing frame with a holder, the apparatus comprising:

a mount for securing the registration apparatus to a printing machine;

an appendage pivotably attached to the mount by a coupling;

a registration means attached to the appendage for engaging with a registration element located on a screen printing frame;

the appendage being pivotable with respect to a screen printing frame holder into and out of a registration position, in the registration position the appendage is aligned with the screen printing frame holder and the registration means is positioned to be engaged by the registration element on a screen printing frame which is securable by the holder and when out of the registration position the registration means is retracted away from the screen printing frame; and a detent for releasably fixing the appendage in the registration position.

18. The retractable registration apparatus according to claim 17, wherein the detent comprises one of a pin and plurality of spaced holes located on the appendage and the other of the pin and spaced holes located on the mount.

19. The retractable registration apparatus according to claim 17, wherein the coupling comprises a rotatable plunger bolt interposed between the mount and the appendage for rotating the appendage into and away from a registration position.

20. The retractable registration apparatus according to claim 19, wherein a bore is formed in the mount, the plunger bolt extends through the bore, and wherein the coupling further comprising a spring which encircles the plunger bolt, the spring being received by the bore within the mount for biasing the appendage to an engaged position within the mount.

21. The retractable registration apparatus according to claim 17, wherein the mount is adjustably mounted on the printing machine for accommodating variously-sized screen printing frames.

* * * * *